United States Patent [19]

Soeters, Jr.

[11] Patent Number: 4,569,646

[45] Date of Patent: Feb. 11, 1986

[54] SUPERCHARGER CARRY-OVER VENTING MEANS

[75] Inventor: Raymond A. Soeters, Jr., Farmington Hills, Mich.

[73] Assignee: Eaton Corporation, Cleveland, Ohio

[21] Appl. No.: 647,074

[22] Filed: Sep. 4, 1984

[51] Int. Cl.[4] ..... F01C 1/16

[52] U.S. Cl. ..... 418/75; 418/189

[58] Field of Search ..... 418/189, 190, 201, 206, 418/75, 79

[56] References Cited

U.S. PATENT DOCUMENTS

| | | | |
|---|---|---|---|
| 859,762 | 7/1907 | Green | 418/189 |
| 1,719,025 | 7/1929 | Scheminger, Jr. | 418/75 |
| 2,014,932 | 9/1935 | Hallett | 418/203 |
| 2,078,334 | 4/1937 | Martocello | 418/203 |
| 2,463,080 | 3/1949 | Beier | 418/206 |
| 2,480,818 | 8/1949 | Whitfield | 418/20 |
| 2,578,196 | 12/1951 | Montelius | 418/203 |
| 3,121,529 | 2/1964 | Hubrich | 418/203 |
| 3,275,226 | 9/1966 | Whitfield | 418/201 |
| 3,531,227 | 9/1970 | Weatherston | 418/94 |
| 3,667,874 | 6/1972 | Weatherston et al. | 418/9 |
| 3,844,695 | 10/1974 | Weatherston | 418/180 |
| 4,097,206 | 6/1978 | Schonherr | 418/78 |
| 4,215,977 | 8/1980 | Weatherston | 418/1 |

*Primary Examiner*—Leonard E. Smith
*Assistant Examiner*—Jane E. Obee
*Attorney, Agent, or Firm*—C. H. Grace; P. S. Rulon

[57] ABSTRACT

An improved supercharger or blower (10) of the Roots-type with reduced airborne noise and improved efficiency. The blower includes a housing (12) defining generally cylindrical chambers (32, 34) containing meshed lobed rotors (14, 16) having the lobes (**14*a*, 14*b*, 14*c*, 16*a*, 16*b*, 16*c*) thereon formed with an end-to-end helical twist according to the relation 360°/2n, where n equals the number of lobes per rotor. The chambers include cylindrical wall surfaces 20*a*, 20*b* and end wall surfaces 20*c*, 24*a* which sealing cooperate with the rotor lobes and ends. Blower housing (12) also defines inlet and outlet ports (36, 38). The inlet port includes a longitudinal extent defined by housing wall surfaces (20*f*, 20*f*) and a transverse extent defined by housing wall surfaces 20*g*, 20*i*. Transverse wall surfaces (20*g*, 20*i*) are disposed substantially parallel to the associated rotor lobes. The outlet port includes a longitudinal extent defined by housing surfaces (20*m*, 20*r*) and a transverse extent defined by housing surfaces (20*p*, 20*s*). Spaces (32*a*, 34*a*) between adjacent lobes of each rotor transfer volumes of low-pressure inlet port air to relatively high-pressure outlet port air. Associated with the outlet port are first and second expanding orifices (42, 44) disposed on transversely opposite sides of the outlet port for controlling the rate of backflow into the transfer volumes and operative at predetermined rotor speed and pressure differential relationships to maintain a substantially constant backflow rate into each of the transfer volumes. Pairs of arcuate channels 46, 48 and 58, 60 are respectively formed in end walls 20*c*, 24*a* to vent trapped volumes $\Sigma TV_1$ and $\Sigma TV_2$ defined by meshing lobes. Channels 46, 48** prevent compression of air in trapped volumes $\Sigma TV_1$ and channels $\Sigma TV_2$ prevent vacuum tending expansion of trapped volumes $\Sigma TV_2$.

12 Claims, 16 Drawing Figures

FIG. 6.
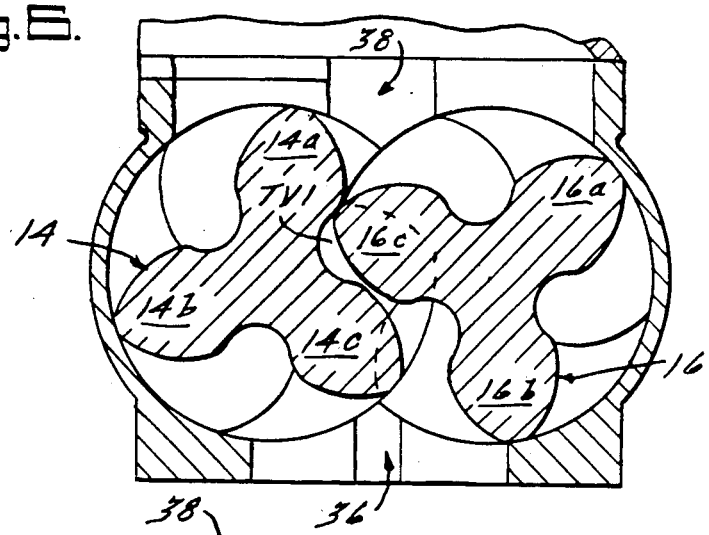
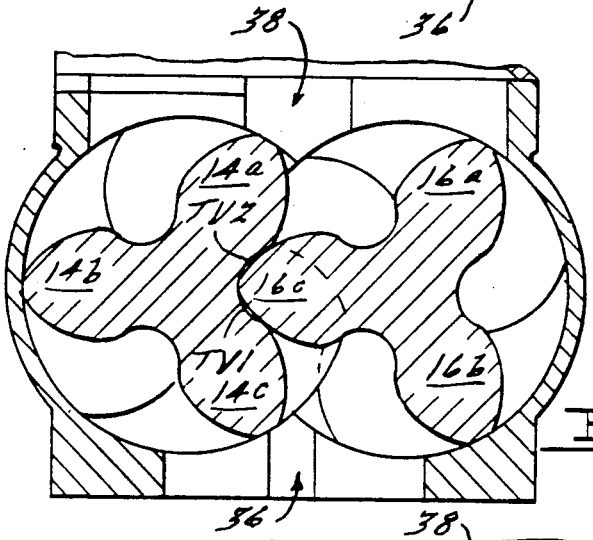
FIG. 7.
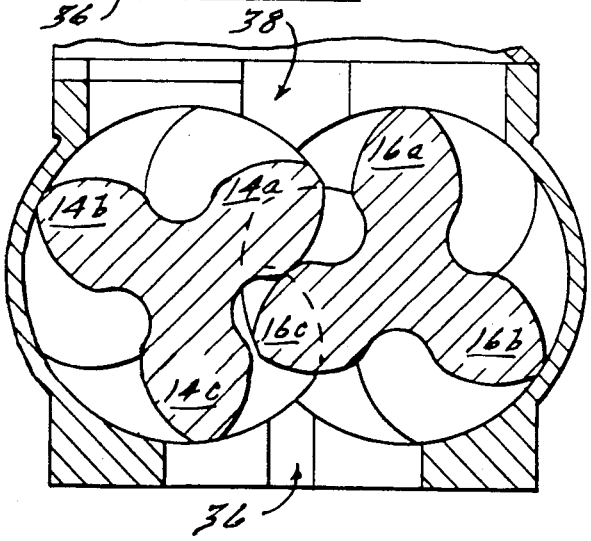
FIG. 8.

SUPERCHARGER CARRY-OVER VENTING MEANS

CROSS-REFERENCE TO RELATED APPLICATIONS

The invention of this application relates to U.S. application Ser. Nos. 647,071, 647,072, and 647,073, filed Sept. 4, 1985. These applications are assigned to the assignee of this application.

BACKGROUND OF THE INVENTION

1. Field of the Invention

This invention relates to rotary compressors or blowers, particularly to blowers of the backflow type. More specifically, the present invention relates to improvements in efficiency and to reducing airborne noise associated with Roots-type blowers emploed as superchargers for internal combustion engines.

2. Description of the Prior Art

Rotary blowers particularly Roots-type blowers are characterized by noisy operation. The blower noise may be roughly classified into two groups: solid borne noise caused by rotation of timing gears and rotor shaft bearings subjected to fluctuating loads, and fluid borne noise caused by fluid flow characteristics such as rapid changes in fluid velocity. Fluctuating fluid flow contributes to both solid and fluid borne noise.

As is well-known, Roots-type blowers are similar to gear-type pumps in that both employ toothed or lobed rotors meshingly disposed in transversely overlapping cylindrical chambers. Top lands of the lobes sealingly cooperate with the inner surfaces of the cylindrical chambers to trap and transfer volumes of fluid between adjacent lobes on each rotor. Roots-type blowers are used almost exclusively to pump or transfer volumes of compressible fluids, such as air, from an inlet receiver chamber to an outlet receiver chamber. Normally, the inlet chamber continuously communicates with an inlet port and the outlet chamber continuously communicates with an outlet port. The inlet and outlet ports often have a transverse width nominally equal to the transverse distance between the axes of the rotors. Hence, the cylindrical wall surfaces on either side of the ports are nominally 180° in arc length. Each receiver chamber volume is defined by the inner boundary of the associated port, the meshing interface of the lobes, and sealing lines between the top lands of the lobes and cylindrical wall surfaces. The inlet receiver chamber expands and contracts between maximum and minimum volumes while the outlet receiver chamber contracts and expands between like minimum and maximum volumes. In most Roots-type blowers, transfer volumes are moved to the outlet receiver chamber without compression of the air therein by mechanical reduction of the transfer volume size. If outlet port air pressure is greater than the air pressure in the transfer volume, outlet port air rushes or backflows into the volumes as they become exposed to or merged into the outlet receiver chamber. Backflow continues until pressure equalization is reached. The amount of backflow air and rate of backflow are, of course, a function of pressure differential. Backflow into one transfer volume which ceases before backflow starts into the next transfer volume, or which varies in rate, is said to be cyclic and is a known major source of airborne noise.

Another major source of airborne noise is cyclic variations in volumetric displacement or nonuniform displacement of the blower. Nonuniform displacement is caused by cyclic variations in the rate of volume change of the receiver chamber due to meshing geometry of the lobes and due to trapped volumes between the meshing lobes. During each mesh of the lobes first and second trapped volumes are formed. The first trapped volumes contain outlet port or receiver chamber air which is abruptly removed from the outlet receiver chamber as the lobes move into mesh and abruptly returned or carried back to the inlet receiver chamber as the lobes move out of mesh. As the differential pressure between the receiver chambers increases, so does the mass of carry-over air to the inlet receiver chamber with corresponding increases in the rate of volume change in the receiver chambers and corresponding increases in airborne noise. Further, blower efficiency decreases as the mass of carry-over air increases.

The trapped volumes are further sources of airborne noise and inefficiency for both straight and helical lobed rotors. With straight lobed rotors, both the first and second trapped volumes are formed along the entire length of the lobes, whereas with helical lobed rotors, the trapped volumes are formed along only a portion of the length of the lobes with a resulting decrease in the degrading effects on noise and efficiency. The first trapped volumes contain outlet port air and decrease in size from a maximum to a minimum, with a resulting compressing of the fluid therein. The second trapped volumes are substantially void of fluid and increase in size from a minimum to a maximum with a resulting vacuum tending expansion. The resulting compression of air in the first trapped volumes, which are subsequently expanded back into the inlet port, and expansion of the second trapped volumes are sources of airborne noise and inefficiencies.

Many prior art patents have addressed the problems of airborne noise. For example, it has long been known that nonuniform displacement, due to meshing geometry, is greater when rotor lobes are straight or parallel to the rotor axes and that substantially uniform displacement is provided when the rotor lobes are helically twisted. U.S. Pat. No. 2,014,932 to Hallett teaches substantially uniform displacement with a Roots-type blower having two rotors and three 60° helical twist lobes per rotor. Theoretically, such helical lobes could or would provide uniform displacement were it not for cyclic backflow and trapped volumes. Nonuniform displacement, due to trapped volumes, is of little or no concern with respect to the Hallett blower since the lobe profiles therein inherently minimize the size of the trapped volumes. However, such lobe profiles, in combination with the the helical twist, can be difficult to accurately manufacture and accurately time with respect to each other when the blowers are assembled.

Hallett also addressed the backflow problem and proposed reducing the initial rate of backflow to reduce the instantaneous magnitude of the backflow pulses. This was done by a mismatched or rectangular shaped outlet port having two sides parallel to the rotor axes and, therefore, skewed relative to the traversing top lands of the helical lobes. U.S. Pat. No. 2,463,080 to Beier discloses a related backflow solution for a straight lobe blower by employing a triangular outlet port having two sides skewed relative to the rotor axes and, therefore, mismatched relative to the traversing lands of the straight lobes. The arrangement of Hallett and Beier slowed the initial rate of backflow into the transfer volume and therefore reduced the instantaneous magnitude of the backflow. However, neither teaches nor suggests controlling the rate of backflow so as to obtain a continuous and constant rate of backflow.

Several other prior art U.S. Patents have also addressed the backflow problem by preflowing outlet port or receiver chamber air into the transfer volumes before the lands of the leading lobe of each transfer volume traverses the outer boundary of the outlet port. In some of these patents, preflow is provided by passages of fixed flow area through the cylindrical walls of the housing sealing cooperating with the top lands of the rotor lobes. Since the passages are of fixed flow area, the rate of preflow decreases with decreasing differential pressure. Hence, the rate of preflow is not constant.

U.S Pat. No. 4,215,977 to Weatherston discloses preflow and purports to provide a Roots-type blower having uniform displacement. However, the lobes of Weatherston are straight and, therefore, believed incapable of providing uniform displacement due to meshing geometry.

The Weatherston blower provides preflow of outlet receiver chamber air to the transfer volumes via circumferentially disposed, arcuate channels or slots formed in the inner surfaces of the cylindrical walls which sealingly cooperate with the top lands of the rotor lobes. The top lands and channels cooperate to define orifices for directing outlet receiver chamber air into the transfer volumes. The arc or setback length of the channels determines the beginning of preflow. Weatherston suggests the use of additional channels of lesser setback length may be employed to hold the rate of preflow relatively constant as pressure in the transfer volumes increases. The Weatherston preflow arrangement, which is analogous to backflow, is believed theoretically capable of providing a relatively constant preflow rate for predetermined blower speeds and differential pressures. However, to obtain relatively constant preflow, several channels of different setback length would be necessary. Further, accurate and consistent forming of the several channels on the interior surface of the cylindrical walls is, at best, an added manufacturing cost.

With respect to airborne noise and inefficiencies respectively caused by compression and expansion of first and second trapped volumes, U.S. Pat. No. 2,578,196 to Montelius discloses an arrangement for porting air in first trapped volumes back to the outlet port. The objective of the Montelius arrangement is to prevent or reduce pumping losses associated with the first trapped volumes and offers no solution to noise and inefficiencies associated with expansion of the second trapped volumes. The arrangement requires the addition of a plate fixed to an end of one rotor to prevent direct communication between the inlet and outlet ports. The plate, in addition to being an added expense, precludes implementation of the Montelius arrangement in Roots-type blowers wherein two pairs of transversely spaced apart trapped volumes are formed in the root areas of both rotors.

SUMMARY OF THE INVENTION

An object of the present invention is to provide a rotary blower of the backflow type for compressible fluids which is relatively free of airborne noises due to compression and expansion of trapped volumes.

Another object of the present invention is to provide a rotary blower of the backflow type for compressible fluids wherein nonuniform displacement, due to meshing geometry and trapped volumes, is substantially eliminated, and wherein airborne noise and inefficiencies associated with compression and expansion of trapped volumes is greatly reduced.

According to an important feature of the present invention, a rotary blower of the backflow type includes a housing defining first and second parallel, transversely overlapping, cylindrical chambers having cylindrical and end wall surfaces; first and second meshed lobed rotors respectively disposed in the first and second chambers for transferring volumes of compressible low-pressure inlet port fluid via spaces between adjacent unmeshed lobes of each rotor to high-pressure outlet port fluid, the rotors and lobes sealingly cooperate with the wall surfaces, and the meshing lobes sealingly cooperate with each other; first and second volumes defined by spaces between the meshing lobes, the first volume isolated from the second volume and the ports by the sealing cooperation during at least a portion of each mesh of the lobes, and the first volume containing outlet port fluid and decreasing in size from a maximum to a minimum while the second volume increases in size from a minimum to a a maximum. The improvement comprises first and second passages formed in at least one end wall of the chamber for alternately communicating alternately formed first volumes with the associated second volumes during alternate mesh of the lobes.

BRIEF DESCRIPTION OF THE DRAWINGS

A Roots-type blower intended for use as a supercharger is illustrated in the accompanying drawings in which:

FIGS. 6–8 are reduced views of the blower section of FIG. 2 with the meshing relationships of the rotors therein varied;

FIG. 16 is a reduced schematic view of the right end of the rotors looking along line 16—16 of FIG. 1.

DETAILED DESCRIPTION OF THE DRAWINGS

FIGS. 1–4 illustrate a rotary pump or blower 10 of the Roots-type. As previously mentioned, such blowers are used almost exclusively to pump or transfer volumes of compressible fluid, such as air, from an inlet port to an outlet port without compressing the transfer volumes prior to exposure to the outlet port. The rotors operate somewhat like gear-type pumps, i.e., as the rotor teeth or lobes move out of mesh, air flows into volumes or spaces defined by adjacent lobes on each rotor. The air in the volumes is then trapped therein at substantially inlet pressure when the top lands of the trailing lobe of each transfer volume moves into a sealing relation with the cylindrical wall surfaces of the associated chamber. The volumes of air are transferred or exposed to outlet air when the top land of the leading lobe of each volume moves out of sealing relation with the cylindrical wall surfaces by traversing the boundary of the outlet port. If the volume of the transfer volumes remains constant during the trip from inlet to outlet, the air therein remains at inlet pressure, i.e., transfer volume air pressure remains constant if the top lands of the leading lobes traverse the outlet port boundary before the volumes are squeezed by virtue of remeshing of the lobes. Hence, if air pressure at the discharge port is greater than inlet port pressure, outlet port air rushes or backflows into the transfer volumes as the top lands of the leading lobes traverse the outlet port boundary.

Figure 1:
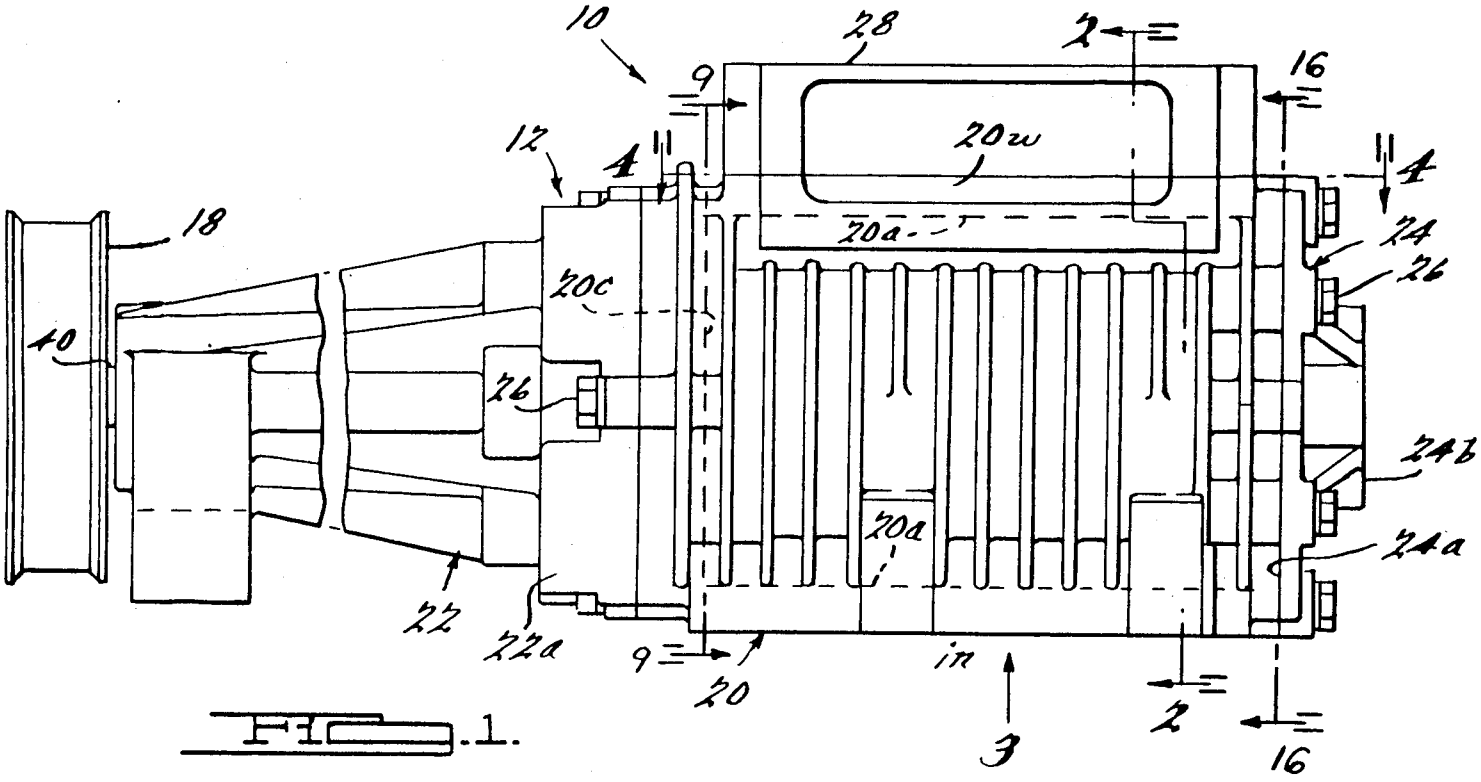
FIG. 1 is a side elevational view of the Roots-type blower.
Figure 2:
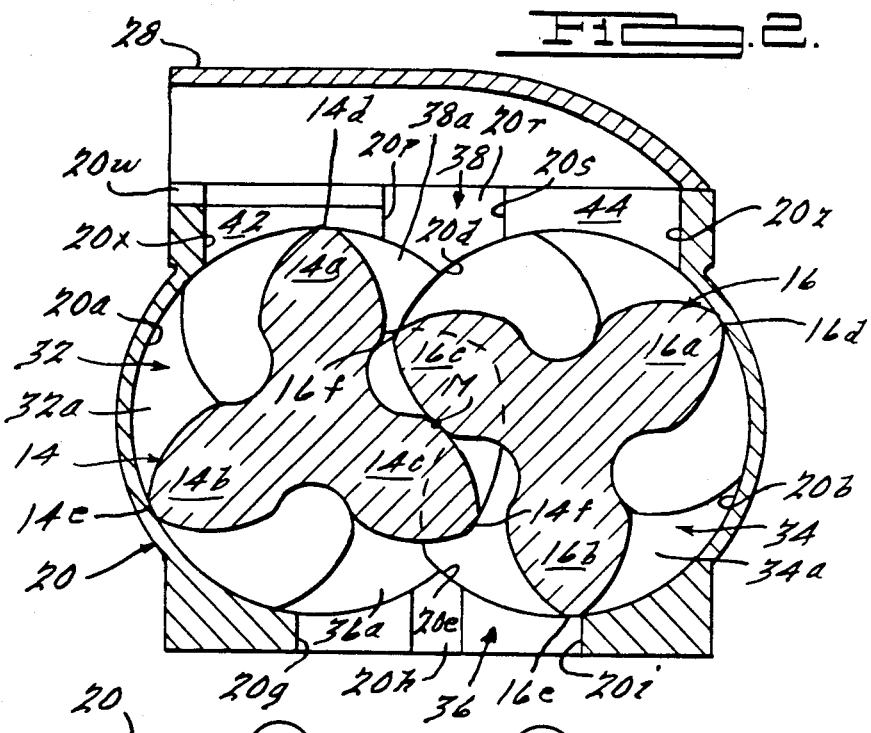
FIG. 2 is a schematic sectional view of the blower looking along line 2—2 of FIG. 1.

Blower 10 includes a housing assembly 12, a pair of lobed rotors 14, 16, and an input drive pulley 18. Housing assembly 12, as viewed in FIG. 1, includes a center section 20, left and right end sections 22, 24 secured to opposite ends of the center section by a plurality of bolts 26, and an outlet duct member 28 secured to the center section by a plurality of unshown bolts. The housing assembly and rotors are preferably formed from a lightweight material such as aluminum. The center section and end 24 define a pair of generally cylindrical working chambers 32, 34 circumferentially defined by cylindrical wall portions or surfaces 20*a*, 20*b*, an end wall surface indicated by phantom line 20*c* in FIG. 1, and an end wall surface 24*a*. Chambers 32, 34 traversely overlap or intersect at cusps 20*d*, 20*e*, as seen in FIG. 2. Openings 36, 38 in the bottom and top of center section 20 respectively define the transverse and longitudinal boundaries of inlet and outlet ports.

Rotors 14, 16 respectively include three circumferentially spaced apart helical teeth or lobes 14*a*, 14*b*, 14*c* and 16*a*, 16*b*, 16*c* of modified involute profile with an end-to-end twist of 60°. The lobes or teeth mesh and preferably do not touch. A sealing interface between meshing lobes 14*c*, 16*c* is represented by point M in FIG. 2. Interface or point M moves along the lobe profiles as the lobes progress through each mesh cycle and may be defined in several places as shown in FIG. 7. The lobes also include top lands 14*d*, 14*e*, 14*f*, and 16*d*, 16*e*, 16*f*. The lands move in close sealing noncontacting relation with cylindrical wall surfaces 20*a*, 20*b* and with the root portions of the lobes they are in mesh with. Rotors 14, 16 are respectively mounted for rotation in cylindrical chambers 32, 34 about axes coincident with the longitudinally extending, transversely spaced apart, parallel axes of the cylindrical chambers. Such mountings are well-known in the art. Hence, it should suffice to say that unshown shaft ends extending from and fixed to the rotors are supported by unshown bearings carried by end wall 20*c* and end section 24. Bearings for carrying the shaft ends extending rightwardly into end section 24 are carried by outwardly projecting bosses 24*b*, 24*c*. The rotors may be mounted and timed as shown in U.S. Pat. application Ser. No. 506,075, filed June 20, 1983 and incorporated herein by reference. Rotor 16 is directly driven by pulley 18 which is fixed to the left end of a shaft 40. Shaft 40 is either connected to or an extension of the shaft end extending from the left end of rotor 16. Rotor 14 is driven in a conventional manner by unshown timing gears fixed to the shaft ends extending from the left ends of the rotors. The timing gears are of the substantially no backlash type and are disposed in a chamber defined by a portion 22*a* of end section 22.

The rotors, as previously mentioned herein have three circumferentially spaced lobes of modified involute profile with an end-to-end helical twist of 60°. Rotors with other than three lobes, with different profiles and with different twist angles may be used to practice certain aspects or features of the inventions disclosed herein. However, to obtain uniform displacement based on meshing geometry and trapped volumes, the lobes are preferably provided with a helical twist from end-to-end which is substantially equal to the relation 360°/2n, where n equals the number of lobes per rotor. Further, involute profiles are also preferred since such profiles are more readily and accurately formed than most other profiles; this is particularly true for helically twisted lobes. Still further, involute profiles are preferred since they have been more readily and accurately timed during supercharger assembly.

As may be seen in FIG. 2, the rotor lobes and cylindrical wall surfaces sealingly cooperate to define an inlet receiver chamber 36*a*, an outlet receiver chamber 38*a*, and transfer volumes 32*a*, 34*a*. For the rotor positions of FIG. 2, inlet receiver chamber 36*a* is defined by portions of the cylindrical wall surfaces disposed between top lands 14*e*, 16*e* and the lobe surfaces extending from the top lands to the interface M of meshing lobes 14*c*, 16*c*. Interface M defines the point or points of closest contact between the meshing lobes. Likewise, outlet receiver chamber 38*a* is defined by portions of the cylindrical wall surfaces disposed between top lands 14*d*, 16*d* and the lobe surfaces extending from the top lands to the interface M of meshing lobes 14*c*, 16*c*. During each meshing cycle and as previously mentioned, meshing interface M moves along the lobe profile and is often defined at several places such as illustrated in FIGS. 6 and 7. The cylindrical wall surfaces defining both the inlet and outlet receiver chambers include those surface portions which were removed to define the inlet and outlet ports. Transfer volume 32*a* is defined by adjacent lobes 14*a*, 14*b* and the portion of cylindrical wall surfaces 20*a* disposed between top lands 14*d*, 14*e*. Likewise, transfer volume 34*a* is defined by adjacent lobes 16*a*, 16*b* and the portion of cylindrical wall surface 20*b* disposed between top lands 16*d*, 16*e*. As the rotors turn, transfer volumes 32*a*, 34*a* are reformed between subsequent pairs of adjacent lobes.

Figure 3:
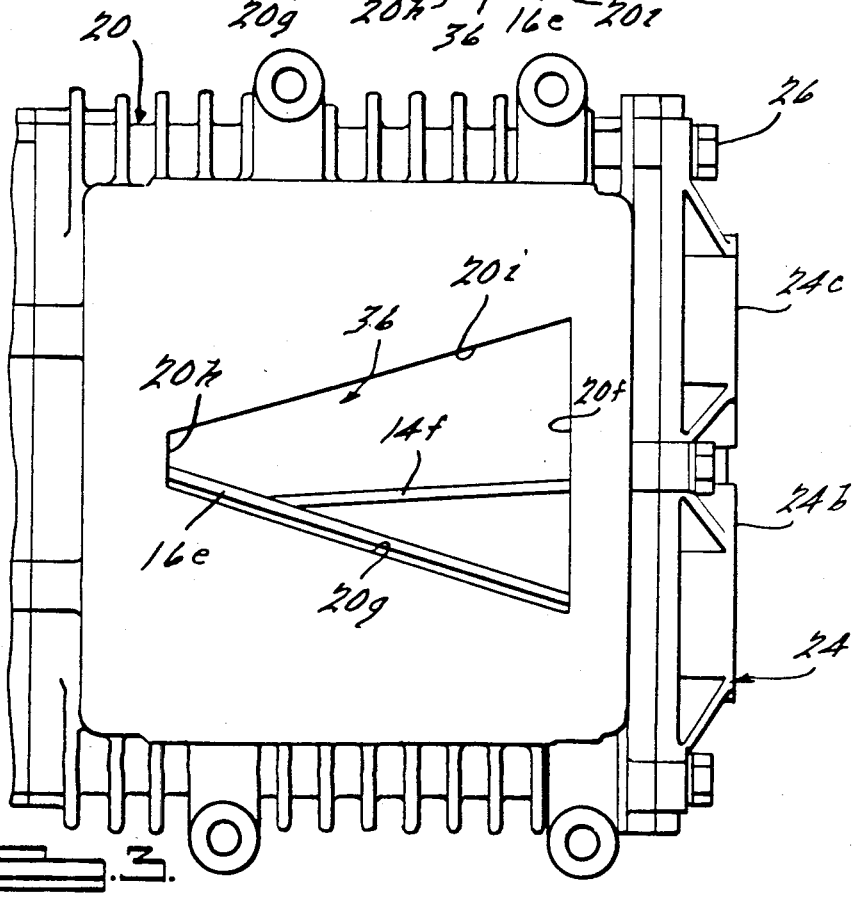
FIG. 3 is a bottom view of a portion of the blower looking in the direction of arrow 3 in FIG. 1.
Figure 4:
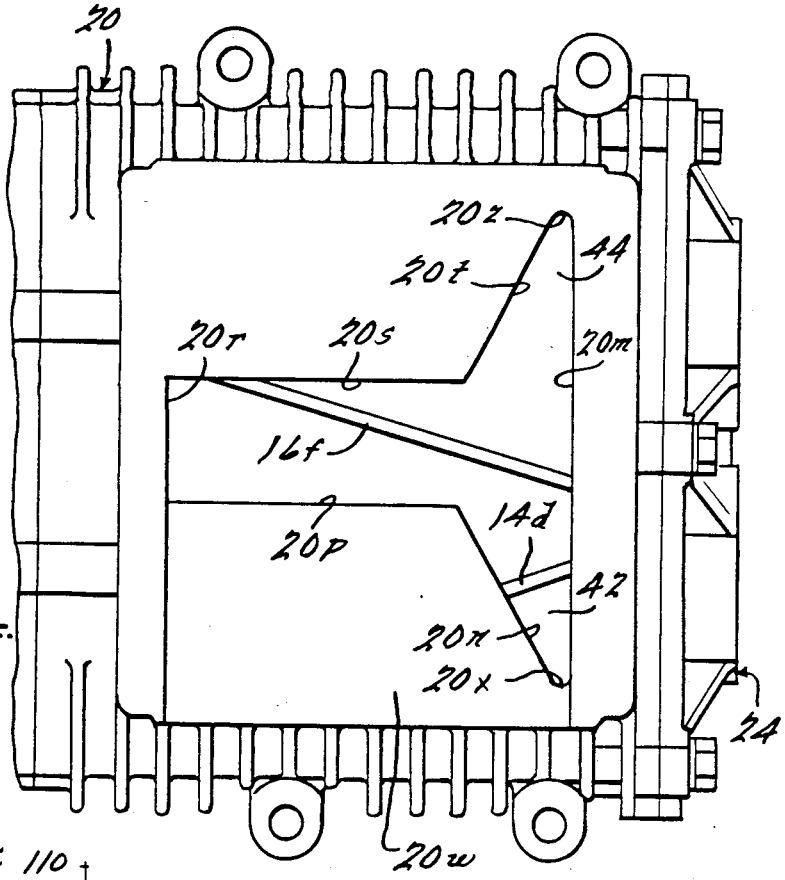
FIG. 4 is a top view of a portion of the blower looking along line 4—4 of FIG. 1.

Inlet port 36 is provided with an opening shaped substantially like an isosceles trapezoid by wall surfaces 20*f*, 20*g*, 20*h*, 20*i* defined by housing section 20. Wall surfaces 20*f*, 20*h* define the longitudinal extent of the port and wall surfaces 20*g*, 20*i* define the transverse boundaries or extent of the port. The isosceles sides or wall surfaces 20*g*, 20*i* are matched or substantially parallel to the traversing top lands of the lobes. The top lands of the helically twisted lobes in both FIGS. 3 and 4 are schematically illustrated as being straight for simplicity herein. As viewed in FIGS. 3 and 4, such lands actually have a curvature. Wall surfaces 20*g*, 20*i* may be curved to more closely conform to the helical twist of the top lands.

Outlet port 38 is provided with a somewhat T-shaped opening by wall surfaces 20*m*, 20*n*, 20*p*, 20*r*, 20*s*, 20*t* defined by housing section 20. The top surface of housing 20 includes a recess 20*w* to provide an increased flow area for outlet duct 28. Wall surfaces 20*m*, 20*r* are parallel and define the longitudinal extent of the port. Wall surfaces 20*p*, 20*s* and their projections to surface 20*m* define the transverse boundaries or extent of the port for outflow of most air from the blower. Wall surfaces 20*p*, 20*s* are also parallel and may be spaced farther apart than shown herein if additional outlet port area is needed to prevent a pressure drop or back pressure across the outlet port. Diagonal wall surfaces 20*n*, 20*t*, which converge with transverse extensions of wall surface 20*m* at apexes 20*x*, 20*z*, define expanding orifices 42, 44 in combination with the traversing top lands of the lobes. The expanding orifices control the rate of back flow air into the transfer volumes. Orifices 42, 44 are designed to expand at a rate operative to maintain a substantially constant backflow rate of air into the transfer volumes when the blower operates at predetermined speed and differential pressure relationships. Apexes 20*x*, 20*z* are respectively spaced approximately 60 rotational degrees from surfaces 20*p*, 20*s* and are alternately traversed by the top lands of the associated lobes. The spacing between inlet port wall surfaces 20*g*, 20*i* and the apexes allows the top lands of the trailing lobes of each transfer volume to move into sealing relation with the cylindrical wall surfaces before backflow starts and allows a full 60° rotation of the lobes for backflow. Apexes 20*x*, 20*z* may be positioned to allow backflow slightly before the top lands of the trailing lobes of each transfer volume move into sealing relation with cylindrical wall surfaces 20*a*, 20*b*, thereby providing a slight overlap between the beginning and ending of backflow to ensure a smoother and continuous transition of backflow from one transfer volume to the the next.

Figure 5:
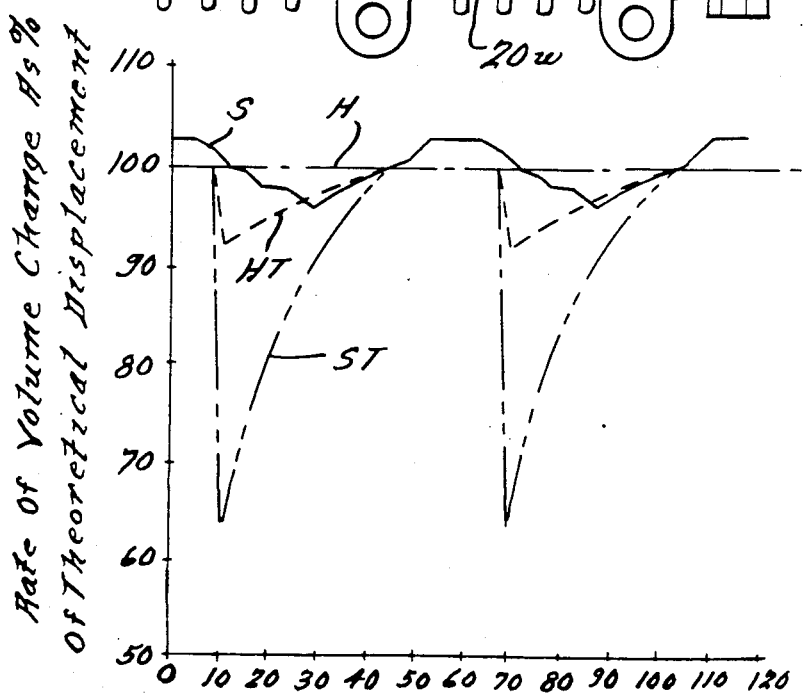
FIG. 5 is a graph illustrating operational characteristics of the blower.

Looking now for a moment at the graph of FIG. 5, therein curves S and H illustrate cyclic variations in volumetric displacement over 60° periods of rotor rotation. The variations are illustrated herein in terms of degrees of rotation but may be illustrated in terms of time. Such cyclic variations are due to the meshing geometry of the rotor lobes which effect the rate of change of volume of the outlet receiver chamber 38*a*. Since the inlet and outlet receiver chamber volumes vary at substantially the same rate and merely inverse to each other, the curves for outlet receiver chamber 38*a* should suffice to illustrate the rate of volume change for both chambers. Curve S illustrates the rate of change for a blower having three straight lobes of modified involute profile per rotor and curve H for a blower having three 60° helical twist lobes of modified involute profile per rotor. As may be seen, the absolute value of rate-of-change is approximately 7% of theoretical displacement for straight lobe rotors while there is no variation in the rate of displacement for 60° helical lobes.

The rate of volume change or uniform displacement for both straight and helical lobes, as previously mentioned, is due in part to the meshing geometry of the lobes. For straight lobes, the meshing relationship of the lobes is the same along the entire length of the lobes, i.e., the meshing relationship at any cross section or incremental volume along the meshing lobes is the same. For example, interface or point M of FIG. 2 is the same along the entire length of the meshing lobes, and a line through the points is straight and parallel to the rotor axis. Hence, a rate of volume change, due to meshing geometry, is the same and additive for all incremental volumes along the entire length of the meshing lobes. This is not the case for helical lobes formed according to the relation 360°/2n. For three lobe rotors having 60° helical lobes, the meshing relationship varies along the entire length of the meshing lobes over a 60° period. For example, if the meshing lobes were divided into 60 incremental volumes along their length, 60 different meshing relationships would exist at any given time, and a specific meshing relationship, such as illustrated in FIG. 2, would first occur at one end of the meshing lobes and then be sequentially repeated for each incremental volume as the rotors turn through 60 rotational degrees. If the meshing relationship of an incremental volume at one end of meshing lobes tends to increase the rate of volume change, the meshing relationship of the incremental volume at the other end of the meshing lobes tends to decrease the rate of volume change an equal amount. This additive-substractive or canceling relationship exists along the entire length of the meshing lobes and thereby cancels rates of volume change or provides uniform displacement with respect to meshing geometry.

Volumes of fluid trapped between meshing lobes are another cause or source affecting the rate of cyclic volume change of the receiver chambers. The trapped volumes are abruptly removed from the outlet receiver chamber and abruptly returned or carried back to the inlet receiver chamber. The trapped volumes also reduce blower displacement and pumping efficiency. Curves ST and HT in the graph of FIG. 5 respectively illustrate the rate of cyclic volume change of the outlet receiver chamber due to trapped volumes for straight and 60° helical twist lobes. As may be seen, the rate of volume change, as a percentage of theoretical displacement due to trapped volumes, is approximately 4.5 times greater for straight lobes. The total rate of volume change of the receiver chamber is obtained by adding the associated curves for meshing geometry and trapped volume together.

Looking briefly at the rightward sectioned end of the rotors, as illustrated in FIGS. 6 and 7, therein is shown areas trapped between adjacent lobes 14*a*, 14*c* and 16*c*. The areas may be thought of as incremental volumes when they have a small depth. The area for the meshing relationship of FIG. 6 represents a maximum incremental volume $TV_1$. With reference to FIG. 7, as the rotors turn, incremental volume $TV_1$, decreases in size while a second incremental volume $TV_2$ is formed which increases in size.

For straight lobe rotors, each maximum incremental volume $TV_1$, is formed along the entire length of the meshing lobes at substantially the same instant. Likewise, each incremental volume $TV_2$ is formed along the entire length of the meshing lobes at substantially the same instant. Hence, the sums $\Sigma TV_1$ and $\Sigma TV_2$ of the incremental volumes define or form trapped volumes. $\Sigma TV_1$ and $\Sigma TV_2$ contribute to airborne noise and reduced blower efficiency. Both, particularly $\Sigma TV_1$, cause substantial rates of volume change as illustrated in the graph of FIG. 5. The carryback of fluid in $\Sigma TV_1$ and the respective decrease and increase in the size of $\Sigma TV_1$ and $\Sigma TV_2$ directly reduce blower efficiency.

Helical lobes greatly reduce the size of $\Sigma TV_1$ and $\Sigma TV_2$; this may be illustrated with reference to FIG. 6, which is a sectioned view of the rightward end of the rotors. With helical lobes, incremental volume $TV_1$ at the rightward end of meshing lobes 14*a*, 14*c* and 16*c* is not trapped and subsequent incremental volumes $TV_1$ from right-to-left are not trapped until the leftward end of lobes 14*a*, 14*c* and 16*c* move into the same meshing relationship. For 60° twist lobes this does not occur until the rotors turn an additional 60°. During this 60° period, each successive incremental volume $TV_1$ from right-to-left decreases in size while still in communication with the outlet receiver chamber. Hence, the number of trapped incremental volumes $TV_1$ is greatly reduced. Further, the total volume of this number of trapped incremental volumes is less than the total volume of a comparable number of straight lobe incremental volumes since trapped incremental volumes with helical lobes vary in cross-sectional area from a minimum to a maximum. The number of trapped incremental volumes $TV_2$ and their total volume is the same as described for incremental volumes $TV_1$. However, their formation sequence occurs in the reverse order, i.e., when incremental volume $TV_2$ starts to form and expand at the right end of the lobes, it and subsequent incremental volumes $TV_2$ are trapped until the right end of the lobes moves to the meshing relationship shown in FIG. 8; from thereon all incremental volumes $TV_2$ are in constant communication with the inlet receiver chamber.

Figure 15:
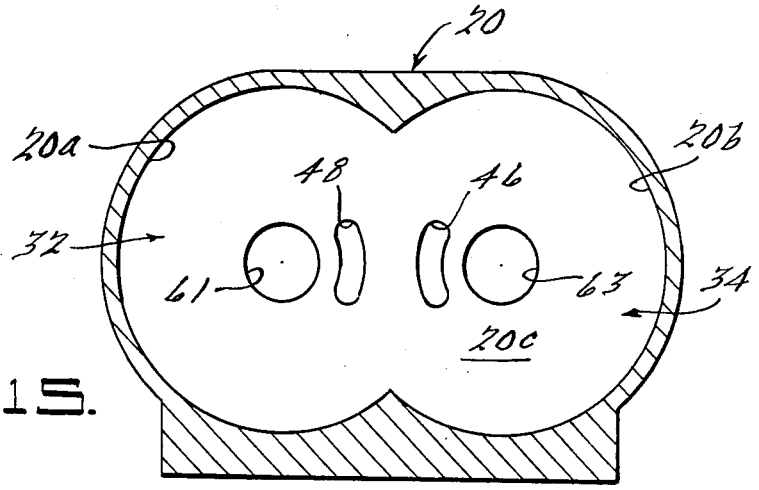
FIG. 15 is a somewhat schematic sectional view of the blower housing looking in the opposite direction of the arrows along line 9—9 of FIG. 1.
Figure 9:
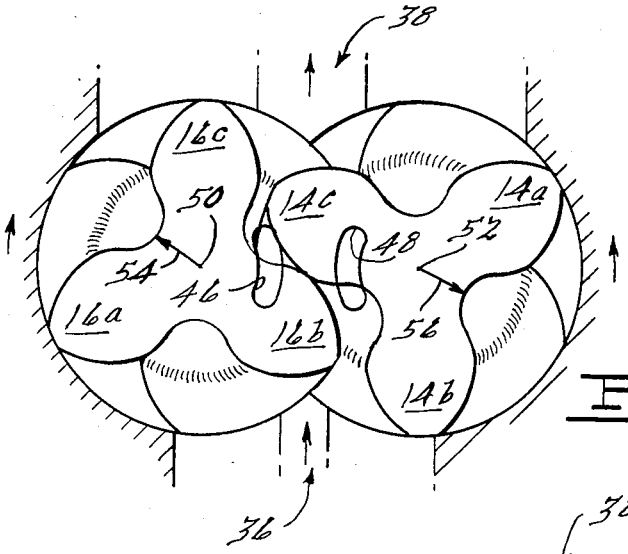
FIGS. 9–14 are reduced schematic views of the left end of rotors shown in FIGS. 2 and 6–8 and looking along line 9—9 of FIG. 1.
Figure 10:
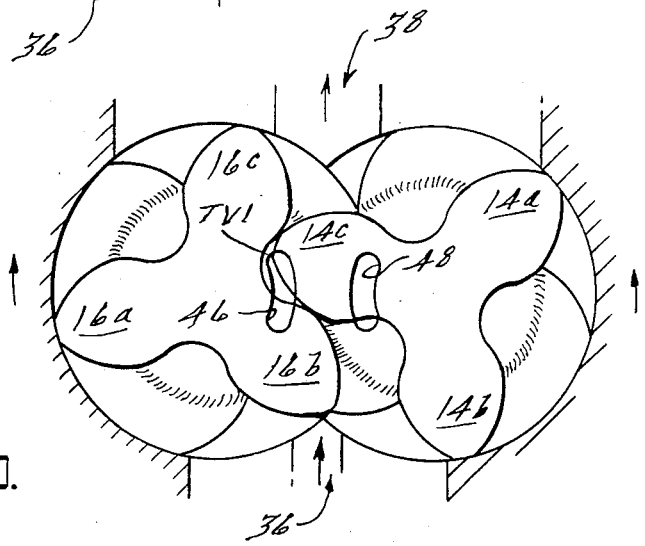
Figure 11:
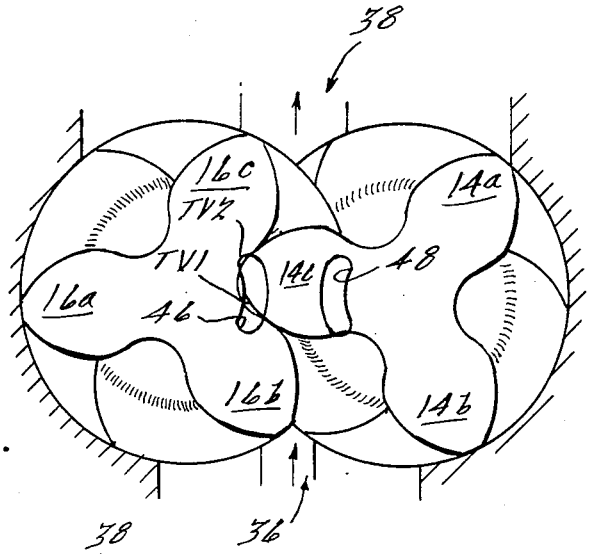
Figure 12:
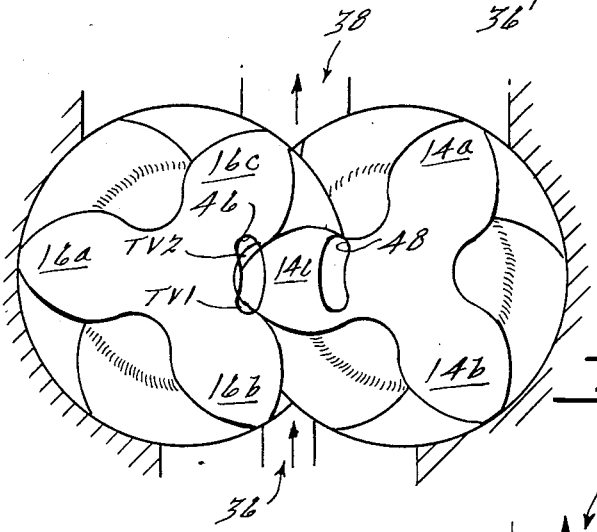
Figure 13:
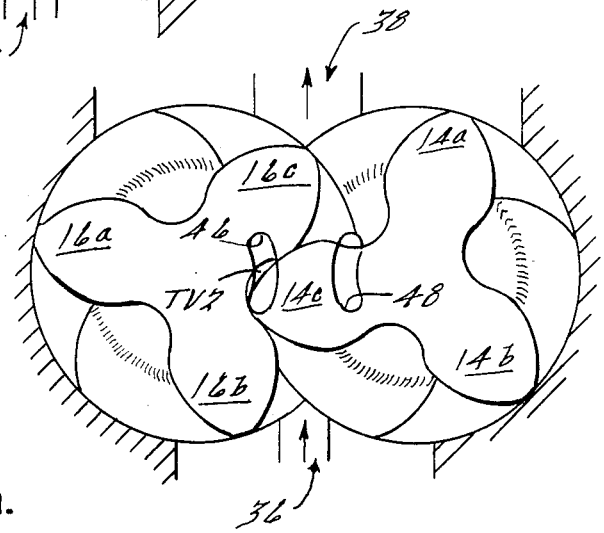
Figure 14:
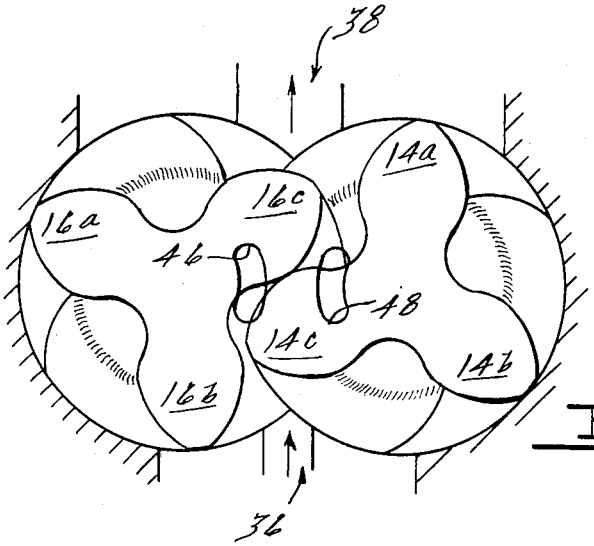
Figure 15:
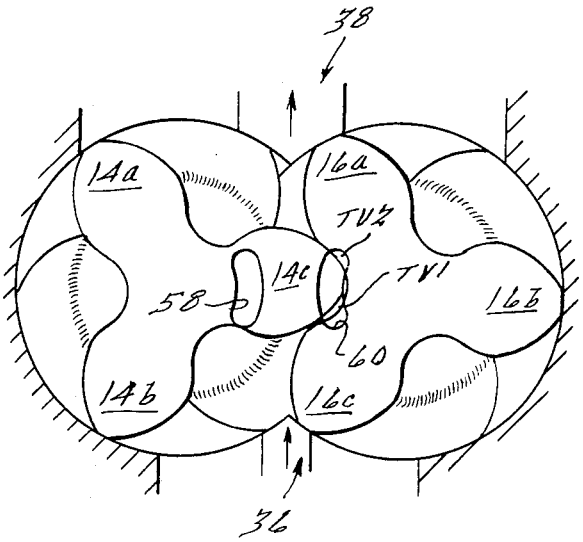

Referring now to the schematic illustrations of FIGS. 9–14, therein is shown a meshing cycle viewed from the left end of helical meshing lobes 14 and **16*b*, 16*c* with the projections of two passages or channels 46, 48 superimposed thereon. The channels, as shown in FIG. 15, are formed in the surface of left end wall 20*c* and provide communication between incremental volumes $TV_1$ and $TV_2$ as they respectively decrease and increase in size. Bearings which would normally be seen in bores 61, 63 in end wall 20*c* are omitted for simplicity. The channels may be straight, but are preferably formed with arcuate sides having their respective centers of radius located at the axes of rotation 50, 52 of the rotors. The side walls formed by the smaller radii are substantially the same as the root diameters or root radii 54, 56 of the lobes. Both channels are approximately 30° in arc length and are centered about an unshown line extended between the axes of rotation. Keeping in mind that the rotors are being viewed from the left end in FIGS. 9–14, when the left end of lobe 14*c* is in the position shown in FIG. 9, i.e., in sealing relation with lobe 16*b* and just prior to moving into a sealing relation with lobe 16*c* as shown in FIG. 10, the right end of lobe 14*c* has already moved out of sealing relation with the lobe 16*b* as shown in FIG. 2. As the lobes continue to rotate, incremental volume $TV_1$ at the left end of the lobes becomes trapped as shown in FIG. 10, thereby completing the trapping of a series of incremental volumes of decreasing cross-sectional area to the right to define the sum of trapped incremental volumes $\Sigma TV_1$ containing air at outlet pressure. The sequence of FIGS. 10–13 illustrate incremental volume $TV_1$ and trapped incremental volume $\Sigma TV_1$ decreasing in size from a maximum to a minimum while incremental volume $TV_2$ forms and increases in size from a minimum to a maximum. During the sequence $TV_1$ and $TV_2$ are in communication with each other via arcuate channel 46 and $TV_2$ is in continuous communication with inlet receiver chamber 36*a***. Hence, compression of the air in $\Sigma TV_1$ is prevented by venting to the inlet receiver chamber.

FIG. 16 schematically illustrates a meshing relationship of lobes **14*c* and 16*a*, 16*c* viewed from the right end of the rotors with projections of two passages or channels 58, 60 superimposed thereon. In a manner analogous to channels 46, 48, channels 58, 60 are formed in the surface of right end wall 24*a*. Channels 58, 60 provide communication between incremental volumes $TV_1$ and $TV_2$ as they respectively decrease and increase in size. Channels 58, 60 are preferably positioned and sized the same as channels 46, 48. At this end of the lobes, i.e., the right end, $TV_1$ is in continuous communication with outlet receiver chamber 38*a*, and $TV_2$ and the expanding sum of incremental volumes $\Sigma TV_2$ to its left are trapped until the lobes move to the position of FIG. 8**. Hence, outlet receiver chamber air is vented to $TV_2$ to prevent a vacuum tending as $\Sigma TV_2$ expands.

The preferred embodiment of the invention has been disclosed in detail for illustrative purposes. Many variations of the disclosed embodiment are believed to be within the spirit of the invention.

The following claims are intended to cover inventive portions of the disclosed embodiment and modifications believed to be within the spirit of the invention.

What is claimed is:

1. In a rotary blower of the backflow type including a housing defining first and second parallel, transversely overlapping cylindrical chambers having cylindrical and end wall surfaces; first and second meshed lobed rotors respectively disposed in the first and second chambers for transferring volumes of compressible low-pressure inlet port fluid via spaces between adjacent unmeshed lobes of each rotor to high-pressure outlet port fluid, the rotors and lobes sealingly cooperate with the wall surfaces, and the meshing lobes sealingly cooperate with each other; first and second volumes defined by spaces between the meshing lobes, the first volume isolated from the second volume and the ports by the sealing cooperation during at least a portion of each mesh of the lobes, and the first volume containing outlet port fluid and decreasing in size from a maximum to a minimum while the second volume increases in size from a minimum to a maximum; the improvement comprising:

first and second passages formed in at least one end wall of said chambers for alternately communicating alternately formed first volumes with the associated second volumes during alternate meshes of the lobes.

2. The blower of claim 1, wherein the rotor lobes are straight and the second volume is also isolated from the ports.

3. The blower of claim 1, wherein the rotor lobes are helical and each second volume is in communication with each first volume via said passages.

4. The blower of claim 1, wherein said first and second passages are respectively associated with the root diameter of the first and second rotors.

5. The blower of claim 4, wherein said passages are channels formed in said one end wall surface.

6. The blower of claim 4, wherein said passages are arcuate channels formed in said one end wall surface with the radius of each centered substantially at the rotational axis of the associated rotor.

7. The blower of claim 6, wherein each arcuate channel has an arc length of substantially 30° centered about a line extending between the axes rotor rotation.

8. The blower of claim 1, wherein the rotor lobes are formed with a helical twist, whereby one end of the lobes moves into a meshing relationship forming the first and second volumes prior to the other end of the lobes moving into such a meshing relationship; the first volume formed at the one end of the lobes being in communication with the outlet port until the other end of the lobes moves into said such a meshing relationship; the second volume formed at the one end of the lobes initially isolated from the ports and subsequentially communicated with the inlet port prior to said such a meshing relationship at the other end of the lobes; said first and second passages disposed adjacent the other end of the lobes in said one end wall for alternately communicating alternately formed first volumes with the associated second volumes while the second volumes communicate with the inlet port; and third and fourth passages formed in the other end wall for alternately communicating alternately formed second volumes with the associated first volumes while the first volumes communicate with the outlet port.

9. The blower of claim 8, wherein said first and second passages are respectively associated with the root diameter of the first and second rotors.

10. The blower of claim 9, wherein said passages are channels formed in said one end wall surface.

11. The blower of claim 9, wherein said passages are arcuate channels formed in said one end wall surface with the radius of each centered substantially at the rotational axis of the associated rotor.

12. The blower of claim 11, wherein each arcuate channel has an arc length of substantially 30° centered about a line extending between the axes rotor rotation.

* * * * *